US006209521B1

(12) United States Patent
Rembold et al.

(10) Patent No.: US 6,209,521 B1
(45) Date of Patent: Apr. 3, 2001

(54) SYSTEM FOR OPERATING AN INTERNAL COMBUSTION ENGINE, IN PARTICULAR OF A MOTOR VEHICLE

(75) Inventors: Helmut Rembold, Stuttgart; Ferdinand Grob, Besigheim; Dirk Mentgen, Schwieberdingen; Heinz Stutzenberger, Vaihingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/254,573

(22) PCT Filed: Jun. 9, 1998

(86) PCT No.: PCT/DE98/01565

§ 371 Date: May 5, 1999

§ 102(e) Date: May 5, 1999

(87) PCT Pub. No.: WO99/02837

PCT Pub. Date: Jan. 21, 1999

(30) Foreign Application Priority Data

Jul. 8, 1998 (DE) ..... 197 29 191

(51) Int. Cl.[7] ..... F02M 4/00; F02M 51/00

(52) U.S. Cl. ..... 123/456; 123/479

(58) Field of Search ..... 123/447, 446, 123/456, 457, 119 A, 479, 480, 295, 357, 514

(56) References Cited

U.S. PATENT DOCUMENTS

| | | | | |
|---|---|---|---|---|
| 4,082,066 | * | 4/1978 | Long | 123/32 EA |
| 4,903,669 | * | 2/1990 | Groff et al. | 123/478 |
| 5,483,940 | * | 1/1996 | Namba et al. | 123/497 |
| 5,492,099 | * | 2/1996 | Maddock | 123/446 |
| 5,493,902 | * | 2/1996 | Gildewell et al. | 73/119 A |
| 5,609,140 | * | 3/1997 | Kramer et al. | 123/497 |
| 5,723,780 | * | 3/1998 | Miwa et al. | 73/119 A |

FOREIGN PATENT DOCUMENTS 1 95 48 278 6/1997 (DE) .

* cited by examiner

*Primary Examiner*—Henry C. Yuen
*Assistant Examiner*—Nahmoud M Gimie
(74) *Attorney, Agent, or Firm*—Kenyon & Kenyon

(57) ABSTRACT

A fuel-supply system for an internal combustion engine, particularly of a motor vehicle. The fuel-supply system is provided with a pump for delivering fuel into a storage chamber and for producing a pressure in the storage chamber. In addition, provision is made for a pressure sensor for measuring an actual value of the pressure in the storage chamber, as well as a pressure-control valve for influencing the pressure in the storage chamber. A control unit is provided with means by which the pressure in the storage chamber is controllable to a setpoint value. In addition, the control unit is provided with means by which the closed-loop control of the pressure in the storage chamber is able to be superseded by an open-loop control.

25 Claims, 2 Drawing Sheets

SYSTEM FOR OPERATING AN INTERNAL COMBUSTION ENGINE, IN PARTICULAR OF A MOTOR VEHICLE

FIELD OF THE INVENTION

The present invention relates to a method for operating a fuel supply system for an internal combustion engine, in particular of a motor vehicle, in which the fuel is conveyed into a storage chamber and a pressure is produced in the storage chamber, in which an actual value of the pressure in the storage chamber is measured, and in which the pressure in the storage chamber is controlled to a setpoint value. In addition, the present invention relates to a fuel supply system for an internal combustion engine, in particular of a motor vehicle. The system includes a pump for delivering fuel into a storage chamber and for producing a pressure in the storage chamber, a pressure sensor for measuring an actual value of the pressure in the storage chamber, a pressure-control valve for influencing the pressure in the storage chamber, and a control unit that is provided with means by which the pressure in the storage chamber is controllable to a setpoint value.

BACKGROUND INFORMATION

Such a fuel supply system is known, for example, in connection with internal combustion engines having direct injection. There, the fuel in the storage chamber is made available under a high pressure. The pressure in the storage chamber is controlled to the desired setpoint value with the aid of the pressure-control valve. To inject the fuel into a combustion chamber of the internal combustion engine, an injection valve belonging to the combustion chamber is opened, and the injected fuel is then ignited with the aid of a spark plug. In internal combustion engines having direct injection, the injection valves are arranged in such a way that the fuel is not injected into an intake manifold or the like, but rather is injected directly into the combustion chambers.

The quantity of fuel to be injected is adjusted with the aid of the period of time the respective injection valve is open. At the same time, this period of time is a function of the pressure in the storage chamber. The greater the pressure, the shorter is the period of time for the injection of the same quantity of fuel. To take into account the pressure in the storage chamber when ascertaining the period of time for injecting, a pressure sensor which measures the actual value of the pressure in the storage chamber is allocated to the storage chamber.

If this pressure sensor is defective, thus if incorrect or no values at all are being measured by the pressure sensor, then, because of this, the period of time, and consequently the proportioning of the fuel quantity to be injected, is falsified.

SUMMARY OF THE INVENTION

The object of the present invention is to provide a method and a fuel-supply system which permit correct injection of fuel, even given a defect in the pressure sensor.

This objective is achieved by the present invention in a method or a fuel-supply system, in that the closed-loop control of the pressure in the storage chamber is superseded by an open-loop control, that is, that the control unit is provided with means by which the closed-loop control of the pressure in the storage chamber is able to be superseded by an open-loop control.

Thus, for example, if the pressure sensor is defective, then the closed-loop control, by which the pressure in the storage chamber is adjusted to the desired setpoint value, is replaced by an open-loop control. With the aid of the open-loop control, it is then possible to take the pressure in the storage chamber into account during the proportioning of the fuel quantity to be injected, at least in so far that a largely correct injection continues to be assured. Thus, the actual values of the pressure in the storage chamber measured by the defective pressure sensor are no longer taken into account in the closed-loop control of the fuel quantity to be injected. Instead, this closed-loop control is superseded, so that the pressure in the storage chamber to be taken into account during the proportioning of the fuel quantity to be injected is then furnished by the open-loop control.

In an advantageous embodiment of the present invention, a fault in the closed-loop control of the pressure in the storage chamber is recognized, and after the recognition of a fault, the closed-loop control is interrupted, and the open-loop control is enabled. In this context, a defect in particular of the pressure sensor can be detected by a plausibility control. For example, the signal driving the pressure-control valve can be compared to the signal emitted by the pressure sensor. If these signals deviate substantially from one another over a longer period of time, then a fault can be inferred from this. After the detection of a fault with respect to the closed-loop control of the pressure in the storage chamber, the closed-loop control can then be superseded by the open-loop control. In this manner, it is assured that the necessity of replacing the closed-loop control by the open-loop control is detected reliably, and that the replacement as such is then carried out reliably.

In an advantageous further embodiment of the present invention, the closed-loop control of the pressure in the storage chamber is superseded by an observer model. Thus, the open-loop control superseding the closed-loop control features an observer model. The observer model ascertains the prevailing, present operating state of the internal combustion engine from a plurality of input signals. An output signal representing a characteristic variable of the internal combustion engine is then generated as a function of this operating state. This output signal can then be used, for example, to simulate the pressure in the storage chamber in the event of a defect in the pressure sensor. Thus, with the aid of the observer model, it is possible to implement the open-loop control to be employed in the event of a defect in the closed-loop control of the pressure in the storage chamber.

It is particularly expedient if the observer model carries out a temperature compensation. In particular, the temperature of the pressure-control valve influencing the pressure in the storage chamber rises relatively strongly during the operation of the internal combustion engine, and especially when the pressure-control valve is in the driven, open state. The result is that the cross-section of the pass-through opening of the pressure-control valve likewise changes. This, in turn, changes the quantity of the fuel flowing through the pressure-control valve, which has a direct effect on the pressure in the storage chamber, and thus on the quantity of fuel to be injected.

When the pressure sensor is functioning correctly, these changes are compensated by a setpoint/actual value comparison of the desired pressure and the actual pressure in the storage chamber, and by the provided closed-loop control of the pressure in the storage chamber. On the other hand, if the pressure sensor is defective, then during the open-loop control superseding the closed-loop control, a temperature compensation is implemented with the aid of the observer model. In so doing, for example, the observer model determines, from a plurality of input signals, an output signal which corresponds to the temperature or to the temperature changes of the pressure-control valve. From this signal, it is then possible to infer the resulting change in the cross-section of the pass-through opening of the pressure-control valve, from which a corresponding compensation can be derived. This temperature compensation can then be taken into account when driving the pressure-control valve, and thus when proportioning the quantity of fuel to be injected.

In another advantageous embodiment of the present invention, a supply voltage which is combined with a temperature-dependent factor is provided for the open-loop control of the pressure in the storage chamber. The supply voltage is applied to the pressure-control valve. If the supply voltage is changed by the temperature-dependent factor, then the changing temperature of the pressure-control valve can be compensated in this manner.

In yet another advantageous embodiment of the present invention, a control voltage which is combined with a temperature-dependent factor is provided for the open-loop and/or closed-looped control of the pressure in the storage chamber. The pressure-control valve is driven by the control voltage. The cross-section of the pass-through opening in the driven, open state of the pressure-control valve is a function of the control voltage. Thus, the control voltage corresponds to the quantity of fuel flowing through the pressure-control valve. If the control voltage is changed by the temperature-dependent factor, then the changing temperature of the pressure-control valve in the driven state can be compensated in this manner.

In an advantageous further embodiment of the present invention, the factor is ascertained as a function of the thermal characteristic of a pressure-control valve influencing the pressure in the storage chamber. In this case, it is particularly expedient if the thermal characteristic of the pressure-control valve is ascertained as a function of the thermal characteristic of a coil of the pressure-control valve. The pass-through opening of the pressure-control valve is influenced electromagnetically. In this context, the cross-section of the pass-through opening is all the larger, the less the control voltage is which is driving the pressure-control valve. In the case of a great control voltage, a high current flows through the coil of the pressure-control valve. The result of this is a heating of the coil. The heating of the coil, in turn, produces a change in the electrical resistance of the coil, which, in turn, leads to a change in the current through the coil, and thus to a change in the cross-section of the pass-through opening of the pressure-control valve. If this thermal characteristic of the coil is taken into account within the framework of the temperature-dependent factor, then a compensation of the described temperature-dependent changes in the cross-section of the pass-through opening can be achieved. In particular, the influence of the heating of the coil can already be remediated, in that it is taken into account when ascertaining the control voltage by a corresponding factor acting upon the control voltage.

It is particularly expedient if the temperature-dependent factor is divided by the supply voltage. Thus fluctuations in the supply voltage do not have an effect on the factor.

BRIEF DESCRIPTION OF THE DRAWINGS

FIG. 1 shows a fuel-supply system 1 which is provided for use in an internal combustion engine of a motor vehicle.

Figure 1:
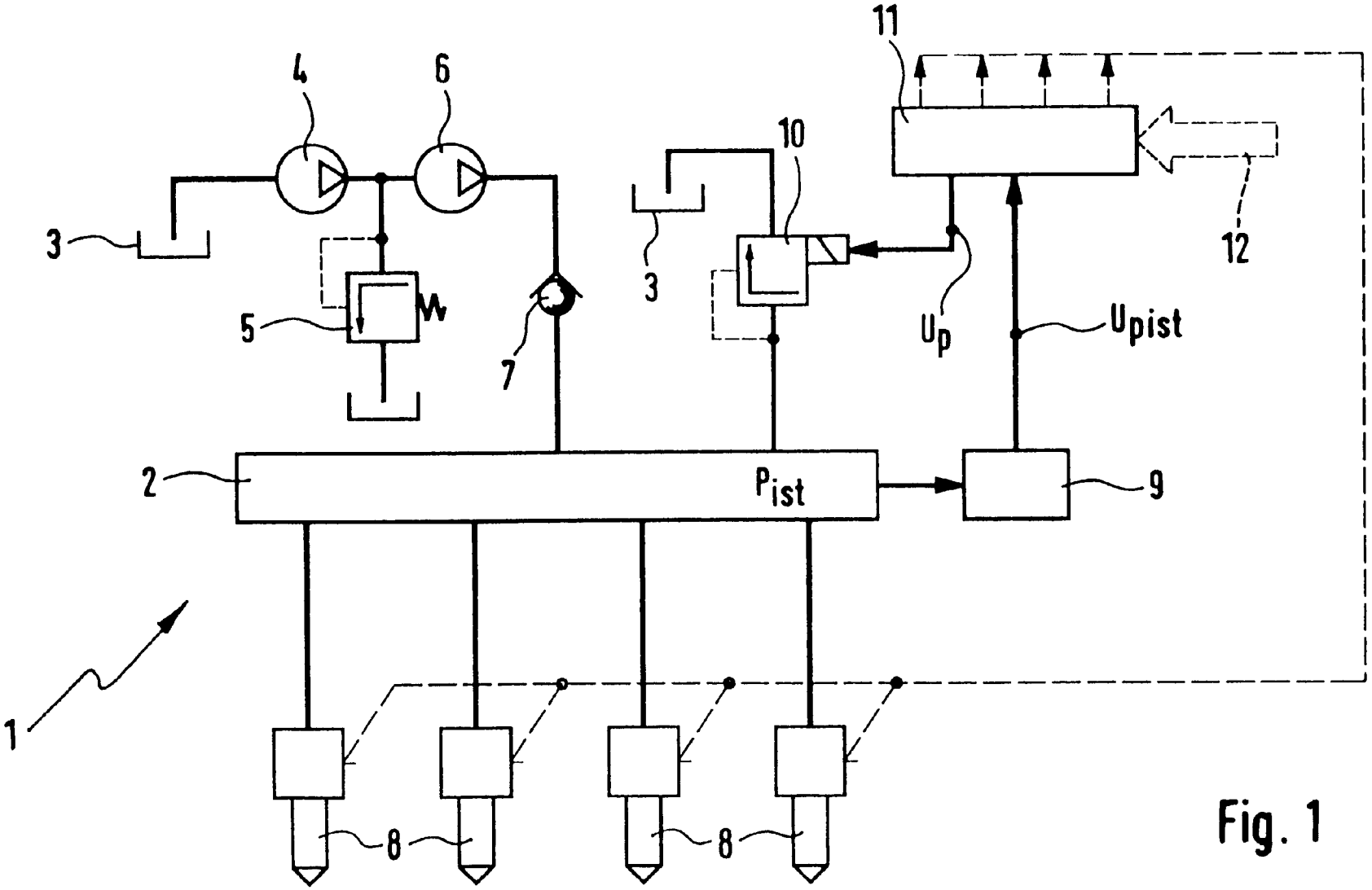
FIG. 1 shows an exemplary embodiment of a fuel-supply system according to the present invention for an internal combustion engine of a motor vehicle.

Fuel-supply system 1 has a storage chamber 2, into which fuel can be delivered from a reservoir 3 by a first pump 4 having a pressure-control valve 5, and by a second pump 6 having a pressure-relief valve 7. Storage chamber 2 is connected to injection valves 8, by which the fuel can be injected into associated combustion chambers of the internal combustion engine. Injection valves 8 are preferably allocated directly to the combustion chambers, so that the fuel is injected directly into the combustion chambers.

Actual pressure $p_{ist}$ in storage chamber 2 is measurable with the aid of a pressure sensor 9 connected to the storage chamber. Pressure sensor 9 generates, as an output voltage, an actual value $U_{pist}$ which corresponds to actual pressure $p_{ist}$.

Also connected to storage chamber 2 is a pressure-control valve 10, in whose open state, fuel can flow back via a pass-through opening into reservoir 3. Pressure-control valve 10 has a coil, whose armature plunges into the pass-through opening of pressure-control valve 10. The cross-section of this pass-through opening is changed by the position of the armature. At the same time, the position of the armature is a function of a control voltage $U_p$, applied to pressure-control valve 10, which can be analog or clocked.

Control voltage $U_p$ of pressure-control valve 10 is generated by a control unit 11, to which actual value $U_{pist}$ is fed as an input signal. In addition, control unit 11 is coupled to receive a plurality of input signals 12 which characterize the respective operating state of the internal combustion engine.

During operation of the internal combustion engine, fuel is pumped by both pumps 4,6 into storage chamber 2. Because of this, pressure $p_{ist}$ is produced in storage chamber 2. This pressure $p_{ist}$ is measured by pressure sensor 9 and transmitted to control unit 11 as actual value $U_{pist}$. Control unit 11, with the aid of pressure-control valve 10, influences pressure $p_{ist}$ in storage chamber 2, as is yet to be described with reference to FIGS. 2*a* and 2*b*. In addition, control unit 11 drives injection valves 8, so that fuel is injected from storage chamber 2 into the combustion chambers of the internal combustion engine. With the aid of spark plugs, the fuel in the combustion chambers is ignited and burned.

Figure 2A:
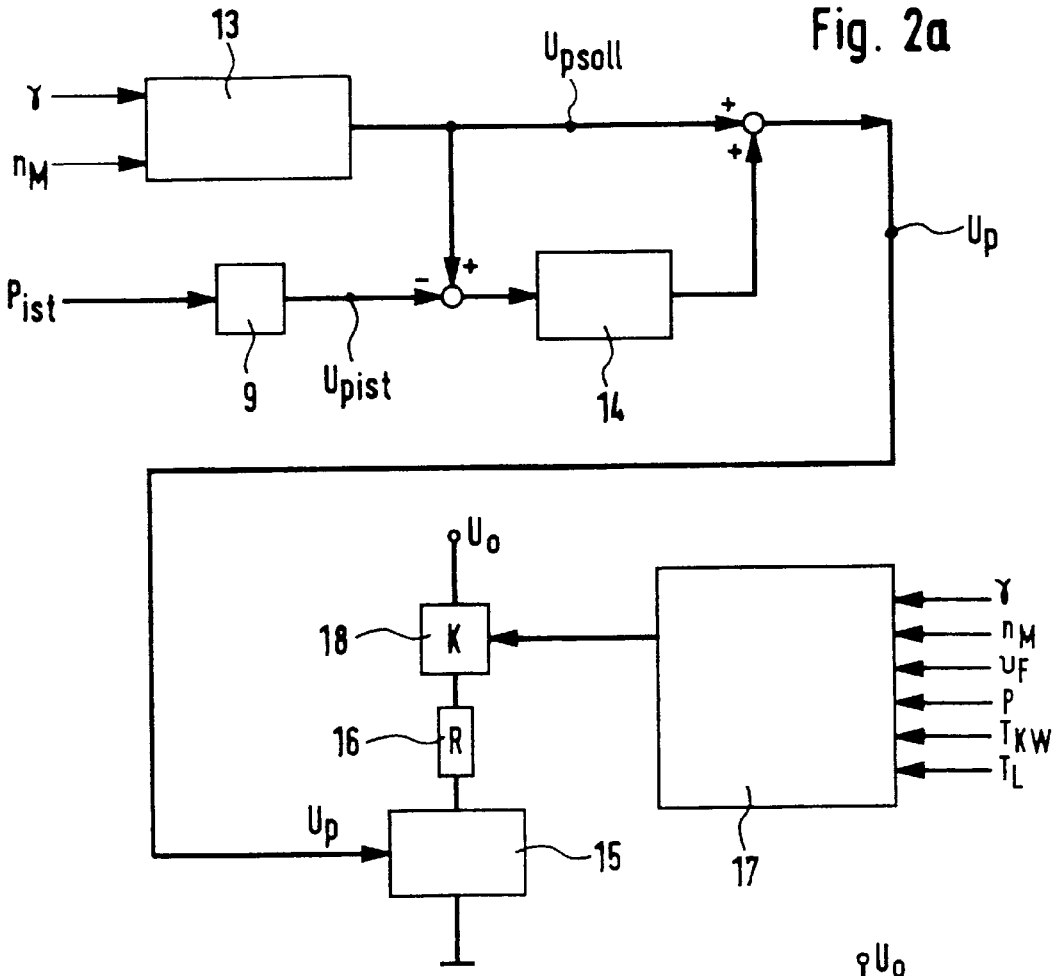
FIG. 2*a* shows a first exemplary embodiment of an open-loop and/or closed-loop control, according to the present invention, of the fuel-supply system of FIG. 1.

FIG. 2*a* shows an open-loop and/or closed-loop control of actual pressure $p_{ist}$ in storage chamber 2. This open-loop and/or closed-loop control is implemented by appropriate means in control unit 11.

By way of a characteristics map 13, an output signal, which represents a setpoint value $U_{psoll}$ for the pressure in storage chamber 2, is generated from a load signal $\gamma$ representing the position of a gas pedal, and thus representing a driver input, and a signal $n_M$ representing the speed of the internal combustion engine. This setpoint value $U_{psoll}$ is compared to actual value $U_{pist}$, and the difference is fed to a controller 14. From this, controller 14 generates an output signal, which is gated additively with setpoint value $U_{psoll}$, for control voltage $U_p$. In the process, this output signal is generated in such a way by controller 14 that the resultant control voltage $U_p$ in fact influences pressure-control valve 10, such that actual value $U_{pist}$ of pressure $p_{ist}$ in storage chamber 2 exactly corresponds to a pressure corresponding with setpoint value $U_{psoll}$.

In FIG. 2*a*, pressure-control valve is represented by an output stage 15 used for the driving, and a resistor 16 depicting the coil. Control voltage $U_p$ is applied to output stage 15, so that a current corresponding to control voltage $U_p$ flows through resistor 16. A change in control voltage $U_p$ causes a change in the indicated current, the result of which is, in turn, that the armature in the coil is shifted by a travel amount corresponding to the change in current. This, in turn, has the result that the cross-section of the pass-through opening in pressure-control valve 10 is further opened or closed. In this manner, more or less fuel can flow off from storage chamber 2 into reservoir 3, which is associated at the same time with a reduction or increase of the actual pressure $p_{ist}$ in storage chamber 2.

The coil is heated by the current flowing across resistor 16. The degree of heating, thus the temperature of the coil, and therefore of pressure-control valve 10, is a function of the current, and thus of control voltage $U_p$ and of its changes. If control voltage $U_p$ is changed by controller 14 or by characteristics map 13, then the temperature of the coil, and consequently resistor 16 also changes. However, a change in resistor 16 has the simultaneous result that, in turn, the current through resistor 16, and thus the current through the coil changes. This leads in principle to a change of pressure $p_{ist}$ in storage chamber 2.

However, the indicated change of pressure $p_{ist}$ in storage chamber 2 is corrected by the setpoint/actual value comparison explained and presented in FIG. 2*a*. Pressure $p_{ist}$ in storage chamber 2 is controlled by controller 14 to the pressure predefined by setpoint value $U_{psoll}$, regardless of changes in the temperature of resistor 16.

In a manner not shown, control voltage $U_p$, which drives pressure-control valve 10, is compared by control unit 11 to actual value $U_{pist}$ produced by pressure sensor 9. This comparison can be performed during the start-up of the internal combustion engine, and/or sporadically and/or cyclically. If the indicated signals deviate substantially from one another over a longer period of time, then control unit 11 infers from this a defect in pressure sensor 9. Alternatively, or in addition to the described comparison, other possibilities for plausibility controls are also conceivable, by which control unit 11 can monitor and recognize the correct functioning of pressure sensor 9.

If control unit 11 recognizes a defect in pressure sensor 9, then the closed-loop control of the pressure in storage chamber 2, clarified and shown in FIG. 2*a*, particularly controller 14 is switched off. Therefore, controller 14 no longer generates an output signal. The result of this is that control voltage $U_p$ corresponds to setpoint value $U_{psoll}$, thus that the control voltage is applied to output stage 15, uninfluenced by actual value $U_{pist}$.

The indicated closed-loop control of the pressure in storage chamber 2 is then superseded by an open-loop control. This means that, after the closed-loop control is switched off, an open-loop control of the pressure in storage chamber 2, which replaces the closed-loop control, is switched on. In this context, this replacement by the open-loop control, as well as the open-loop control as such, is carried out by control unit 11.

An observer model 17 is provided for the open-loop control of the pressure in storage chamber 2. A plurality of input signals which characterize the operating state of the internal combustion engine and/or of the motor vehicle, such as load signal $\gamma$, the speed of the internal combustion engine $n_M$, the velocity of the motor vehicle, the temperature of the coolant, the temperature of the suctioned air, or the like, are fed to this observer model 17. From these input signals, the observer model generates an output signal which acts, via a coupling element 18, as factor k on pressure-control valve 10.

With the aid of observer model 17, a temperature compensation is carried out. This means that, in response to a defective pressure 9, and thus switched-off controller 14, the changes in temperature of pressure-control valve 10 are compensated by observer model 17. Thus, by producing an appropriate factor k, the changes in temperature of pressure-control valve 10 are compensated by observer model 17.

For this purpose, the changes in temperature of pressure-control valve 10 are simulated with the aid of input signals of observer model 17. In so doing, the mathematical relation is as follows:

When, as shown in FIG. 2*a*, pressure-control valve 10 is linked to supply voltage $U_0$, it then holds that: Pressure-control valve 10 has a characteristic whose relation is $p_{ist}$/bar=c×i/ampere. For coil current i, it holds that: i/ampere=$U_p$×$U_0$/volt×k×1/R/ohm. In this case, control voltage $U_p$ represents a normalized controlled variable as follows: $U_p=U_p'/U_{pmax}$, where $0 \leqq U_p \leqq 1$. For resistance R, it holds that: $R=R_0\times(1+\alpha\times\Delta T)$. Yielded from this altogether is:

$$p_{ist}/\text{bar}=c\times U_p\times U_0/\text{volt}\times k\times 1/(R_0\times(1+\alpha\times\Delta T))/\text{ohm} \qquad \text{(equation 1).}$$

Value c is known from the characteristic of pressure-control valve 10. $U_p$ is produced from characteristics map 13 and, because of switched-off controller 14, is equivalent to $U_{psoll}$. $U_0$ is the supply voltage of the motor vehicle. $R_0$ is the reference value of resistor 16 which it exhibits at a specific temperature. $\alpha$ is a constant, by which resistance R, starting from reference value $R_0$, changes in response to a temperature change $\Delta T$ of pressure-control valve 10.

Temperature change $\Delta T$ of pressure-control valve 10 can be calculated by observer model 17 with the aid of a heat-balance calculation from the input signals of observer model 17. In so doing, the hydraulic heat loss which develops in pressure-control valve 10, and which leads to heating of the fuel, plays a role. At the same time, it is also possible that heat is eliminated, for example, during a hot start of the internal combustion engine. In addition, the electrical heat loss in pressure-control valve 10, and the heat-exchange of pressure-control valve 10 with the surroundings play a role. All these heat contributions can be calculated from the input signals, and consequently can be ascertained altogether as $\Delta T$.

At this point, observer model 17 produces factor k exactly in such a way that the temperature-dependence of equation 1, thus the term $(1+\alpha\times\Delta T)$ is compensated. Thus, $k=(1+\alpha\times\Delta T)$ is set. As a result, the following ensues from equation 1:

$$p_{ist}/\text{bar}=c\times U_p\times U_0/\text{volt}\times 1/R_0/\text{ohm} \qquad \text{(equation 2).}$$

Therefore, pressure $p_{ist}$ in storage chamber 2 is linearly dependent upon control voltage $U_p$. Consequently, the temperature-dependence of pressure-control valve 10 is compensated.

In FIG. 2*a*, factor k is coupled in for the compensation, by combining it with supply voltage $U_0$. Thus, supply voltage $U_0$ is changed by factor k. Therefore, in FIG. 2*a*, the open-loop control of the pressure in storage chamber 2 is achieved by a temperature-dependent compensation of supply voltage $U_0$.

Figure 2B:
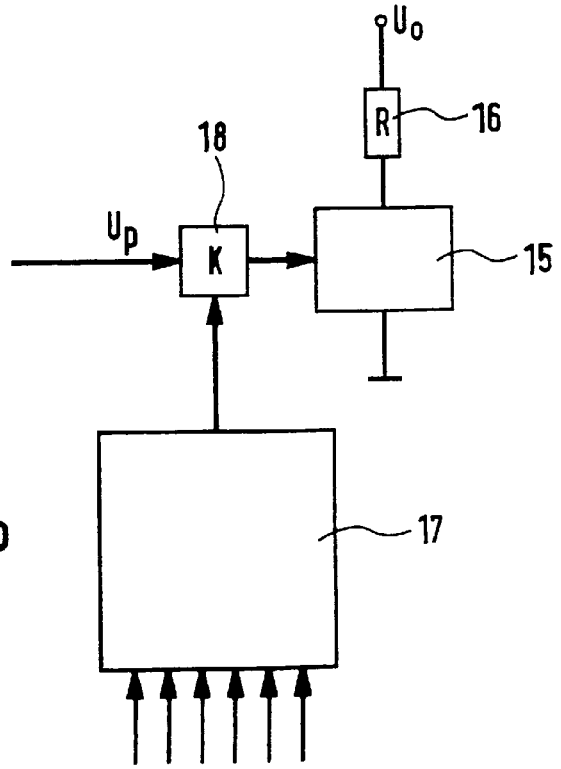
FIG. 2*b* shows a second exemplary embodiment of an open-loop and/or closed-loop control, according to the present invention, of the fuel-supply system of FIG. 1.

FIG. 2*b* shows an open-loop and/or closed-loop control of the actual pressure $p_{ist}$ in storage chamber 2. This open-loop and/or closed-loop control is implemented by appropriate means in control unit 11.

The open-loop and/or closed-loop control of FIG. 2*b* differs from the open-loop and/or closed-loop control of FIG. 2*a* only in the coupling of factor k. For this reason, identical components or functions are also provided with identical reference numerals. A repeated description of FIG. 2*b* is dispensed with. Instead, in the following, only the difference with respect to FIG. 2*a* is clarified.

In FIG. 2*b,* factor k is coupled in for the compensation, by combining it with control voltage $U_p$. Thus, control voltage $U_p$ is changed by factor k. Therefore, in FIG. 2*b,* the open-loop control of the pressure in storage chamber 2 is achieved by a temperature-dependent compensation of control voltage $U_p$.

Furthermore, in FIGS. 2*a* and 2*b,* it is possible to replace factor k by a factor k', for which is valid: $k'=k/U_0/\text{volt}$. This can be achieved, in that, in coupling element 18 of FIGS. 2*a* and 2*b,* factor k is divided by supply voltage $U_0$. In FIG. 2*b,* supply voltage $U_0$ must be fed to coupling element 18 for this purpose.

Yielded then from equation 2 is:

$$p_{ist}/\text{bar}=c\times U_p\times 1/R_0/\text{ohm}.$$

Therefore, it is possible to compensate for the influence of fluctuations of supply voltage $U_0$.

If control voltage $U_p$ is an analog voltage, then factor k or k' can be put into effect directly. If control voltage $U_p$ is a clocked voltage, then yielded from this is a voltage mean which, in the end, corresponds to analog control voltage $U_p$. In this case, factor k or k' can be put into effect by an appropriate change in the clock relation.

What is claimed is:

1. A method for operating a fuel-supply system of an internal combustion engine, comprising the steps of:

providing fuel into a storage chamber;

producing a pressure in the storage chamber;

measuring an actual value of the pressure in the storage chamber;

controlling the pressure in the storage chamber to a predetermined value;

superseding a closed-loop control of the pressure in the storage chamber by an open-loop control of the pressure in the storage chamber;

detecting a fault in the closed-loop control;

after the fault is detected, switching off the closed-loop control and switching on the open-loop control;

superseding the closed-loop control by an observer model control of the pressure; and generating a temperature compensation as a function of the observer model control.

2. The method according to claim 1, wherein the internal combustion engine is contained in a motor vehicle.

3. The method according to claim 1, further comprising the step of:

providing a supply voltage for the open-loop control, the supply voltage being combined with a temperature-dependent factor.

4. The method according to claim 1, further comprising the step of:

providing a control voltage for at least one of the open-loop control and the closed-loop control, the control voltage being combined with a temperature-dependent factor.

5. The method according to claim 3, further comprising the step of:

determining the temperature-dependent factor as a function of a thermal characteristic of a pressure-control valve, the pressure-control valve influencing the pressure.

6. The method according to claim 4, further comprising the step of:

determining the temperature-dependent factor as a function of a thermal characteristic of a pressure-control valve, the pressure-control valve influencing the pressure.

7. The method according to claim 5, further comprising the step of:

determining the thermal characteristic as a function of a further thermal characteristic of a coil of the pressure-control valve.

8. The method according to claim 6, further comprising the step of:

determining the thermal characteristic as a function of a further thermal characteristic of a coil of the pressure-control valve.

9. The method according to claim 2, further comprising the step of:

dividing the temperature-dependent factor by the supply voltage.

10. The method according to claim 4, further comprising the step of:

dividing the temperature-dependent factor by a supply voltage.

11. The method according to claim 2, further comprising the step of:

determining the temperature-dependent factor as a function of at least one of a speed of the internal combustion engine, a velocity of a motor vehicle, a temperature of a coolant and a further temperature of a suctioned air.

12. The method according to claim 4, further comprising the step of:

determining the temperature-dependent factor as a function of at least one of a speed of the internal combustion engine, a velocity of a motor vehicle, a temperature of a coolant and a further temperature of a suctioned air.

13. An computer-readable storage medium of a control unit of an internal combustion engine, the storage medium storing a program which is capable of being executed by a computing device, the program being capable of performing the following steps:

providing fuel into a storage chamber;

producing a pressure in the storage chamber;

measuring an actual value of the pressure in the storage chamber;

controlling the pressure in the storage chamber to a predetermined value;

superseding a closed-loop control of the pressure in the storage chamber by an open-loop control of the pressure in the storage chamber;

detecting a fault in the closed-loop control;

after the fault is detected, switching off the closed-loop control and switching on the open-loop control;

superseding the closed-loop control by an observer model control of the pressure; and generating a temperature compensation as a function of the observer model control.

14. The storage medium according to claim 13, wherein the storage medium includes a read-only memory device.

15. The storage medium according to claim 13, wherein the internal combustion engine is contained in a motor vehicle.

16. The storage medium according to claim 13, wherein the computing device includes a microprocessor.

17. A fuel-supply system of an internal combustion engine, comprising:

a pump delivering fuel into a storage chamber, the pump producing a pressure in the storage chamber;

a pressure sensor measuring an actual value of the pressure in the storage chamber;

a pressure-control valve influencing the pressure in the storage chamber;

a control unit including a first arrangement and a second arrangement, the first arrangement controlling the pressure in the storage chamber to a predetermined setpoint value, the second arrangement allowing a closed-loop control of the pressure in the storage chamber to be superseded by an open-loop control of the pressure in the storage chamber, wherein the control unit includes a third arrangement detecting a particular fault, the third arrangement switching off the closed-loop control and switching on the open-loop control.

18. The system according to claim 17, wherein the internal combustion engine is contained in a motor vehicle.

19. The system according to claim 17, wherein the particular fault includes a fault of the pressure sensor.

20. The system according to claim 17, wherein the control unit combines a supply voltage with a temperature-dependent factor for the open-loop control.

21. The system according to claim 17, wherein the control unit combines a control voltage with a temperature-dependent factor for at least one the open-loop control and the closed-loop control.

22. The system according to claim 20, wherein the control unit includes a fourth arrangement determining the open-loop control as a function of a thermal characteristic.

23. The system according to claim 21, wherein the control unit includes a fourth arrangement determining the open-loop control as a function of a thermal characteristic.

24. The system according to claim 22, wherein the thermal characteristic includes a further thermal characteristic of a coil of the pressure-control valve.

25. The system according to claim 23, wherein the thermal characteristic includes a further thermal characteristic of a coil of the pressure-control valve.

* * * * *